United States Patent [19]

Liston et al.

[11] 4,148,738

[45] Apr. 10, 1979

[54] ANTIOXIDANT ADDITIVE COMPOSITION AND LUBRICATING OIL CONTAINING SAME

[75] Inventors: Thomas V. Liston, San Rafael; Warren Lowe, El Cerrito, both of Calif.

[73] Assignee: Chevron Research Company, San Francisco, Calif.

[21] Appl. No.: 892,443

[22] Filed: Mar. 31, 1978

[51] Int. Cl.[2] ..... C10M 1/48

[52] U.S. Cl. ..... 252/32.7 E; 252/34.7; 252/402

[58] Field of Search ..... 252/32.7 E, 34.7, 402

[56] References Cited

U.S. PATENT DOCUMENTS 3,790,487 2/1974 Burrous ..... 252/34.7

*Primary Examiner*—Delbert E. Gantz
*Assistant Examiner*—Andrew Metz
*Attorney, Agent, or Firm*—D. A. Newell; J. J. DeYoung

[57] ABSTRACT

Disclosed is a lubricating oil additive composition which imparts improved oxidation properties to crankcase lubricants which comprises:

(1) an antioxidant selected from aromatic or alkyl sulfides and polysulfides, sulfurized olefins, sulfurized carboxylic acid esters and sulfurized ester-olefins, and (2) an oil-soluble quaternary ammonium halide. Lubricating oil compositions containing this additive composition are also disclosed.

14 Claims, No Drawings

ANTIOXIDANT ADDITIVE COMPOSITION AND LUBRICATING OIL CONTAINING SAME

BACKGROUND OF THE INVENTION

This invention relates to an improved lubricating composition, and more particularly, this invention relates to a lubricating composition containing an additive combination having improved antioxidation properties.

Hydrocarbon oils are partially oxidized when contacted with oxygen at elevated temperatures for long periods. The internal combustion engine is a model oxidator, since it contacts a hydrocarbon motor oil with air under agitation at high temperatures. Also, many of the metals (iron, copper, lead, nickel, etc.) used in the manufacture of the engine and in contact with both the oil and air, are effective oxidation catalysts which increase the rate of oxidation. The oxidation in motor oils is particularly acute in the modern internal combustion engine which is designed to operate under heavy work loads and at elevated temperatures.

The oxidation process produces acidic bodies within the motor oil which are corrosive to typical copper, lead, and cadmium engine bearings. It has also been discovered that the oxidation products contribute to piston ring sticking, the formation of sludges within the motor oil and an overall breakdown of viscosity characteristics of the lubricant.

Several effective oxidation inhibitors have been developed and are used in almost all of the conventional motor oils today. Typical of these inhibitors are the sulfurized oil-soluble organic compounds, such as wax sulfides and polysulfides, sulfurized olefins, sulfurized fatty acid esters, and sulfurized olefin esters, as well as zinc dithiophosphates and the oil-soluble phenolic and aromatic amine antioxidants. These inhibitors, while exhibiting good antioxidant properties, are burdened by economic and oil contamination problems. It is preferred to maintain the sulfur content of the oil, as low as possible, while at the same time receiving the benefits of the antioxidation property. A need, therefore, exists for an improved antioxidant that is stable at elevated temperatures, that can be employed in reduced concentrations, and that is economical and easy to produce.

DESCRIPTION OF THE PRIOR ART

U.S. Pat. No. 2,958,663 discloses an extreme pressure lubricant composition containing from 0.01 to 5% each of sulfurized oleic acid, $C_{18}$–$C_{22}$ alkenyl succinic acid, chlorinated paraffin wax containing from 20 to 60% chlorine, diphenylamine and N,N-salicylal-1,2-propylenediamine.

U.S. Pat. No. 2,298,640 discloses an extreme pressure lubricating composition containing organic corrosion inhibitors including halogenated organic compounds.

U.S. Pat. No. 3,849,322 discloses an improved lubricant composition with enhanced oxidation stability. The lubricant contains tertiary aromatic amines which may have halogen-containing substituents.

U.S. Pat. No. 2,697,073 discloses a lubricating oil with improved resistance to oxidation. The antioxidant additives include the reaction product of tetrakis(-halomethyl)methane with certain aromatic amines.

U.S. Pat. No. 2,248,925 discloses a lubricant composition particularly adapted for extreme pressure and high temperature conditions which contains a halogen-bearing aromatic amine.

U.S. Pat. No. 3,167,511 discloses a synergistic mixture of a metal working oil containing a sulfurized mineral oil and a chlorinated polyolefin.

It is an object of this invention to provide additive compositions for crankcase lubricating oils which impart improved antioxidant properties. It is a further object of this invention to provide a synergistic additive composition having antioxidant properties in crankcase lubricating oil compositions.

SUMMARY OF THE INVENTION

A lubricating oil additive composition which imparts improved oxidation properties to lubricants which comprises:

(1) an antioxidant selected from aromatic or alkyl sulfides and polysulfides, sulfurized olefins, sulfurized carboxylic acid esters and sulfurized ester-olefins, and (2) an oil-soluble quaternary ammonium halide.

As a second embodiment, there is provided a lubricating oil composition comprising an oil of lubricating viscosity and an antioxidant amount of the composition described above.

It has been found that the defined antioxidants in combination with an oil-soluble quaternary ammonium halide complement each other in a synergistic manner, resulting in a combination having antioxidant properties superior to either additive alone. The oil-soluble quaternary ammonium halide component alone has virtually no antioxidant effect. However, when the defined combination of the oil-soluble quaternary ammonium halide and antioxidant is added to a lubricating oil, less of the antioxidant is needed to obtain oxidation control than when the oil-soluble quaternary ammonium halide is not present.

Preferably, from 2 to 40 millimols of an oil-soluble zinc salt is present per kilogram of the lubricating oil composition. While this zinc salt is not required to achieve the synergistic effect from the combination of the antioxidant and the oil-soluble quaternary ammonium halide, an improved lubricating oil composition results from the use of all three additive components.

DETAILED DESCRIPTION OF THE INVENTION

The compositions of this invention are highly stable additives for crankcase lubricating oils and impart excellent antioxidant properties to these oils.

In a preferred embodiment of the lubricating oil composition, 0.25 to 10 weight percent of the antioxidant is present and 0.001 to 5 weight percent of the quaternary ammonium halide is present. The weight ratio of the antioxidant to quaternary ammonium halide is ordinarily in the range of 1 to 0.001–21.

More preferably, 0.25 to about 2 weight percent of the antioxidant is present in the lubricating oil. More preferably, the quaternary ammonium halide is present in the amount of 0.01 to 0.3, preferably 0.05 to 0.3 weight percent.

In a further preferred embodiment, from 9 to 30 mmols per kilogram of the oil-soluble zinc salt is present.

ANTIOXIDANT COMPONENT

The class of antioxidants which may be used are conventional sulfur-containing antioxidants such as wax sulfides and polysulfides, sulfurized olefins, sulfurized carboxylic acid esters and sulfurized ester-olefins.

The sulfurized fatty acid esters are prepared by reacting sulfur, sulfur monochloride, and/or sulfur dichloride with an unsaturated fatty ester under elevated temperatures. Typical esters include $C_1$–$C_{20}$ alkyl esters of $C_8$–$C_{24}$ unsaturated fatty acids, such as palmitoleic, oleic, ricinoleic, petroselinic, vaccenic, linoleic, linolenic, oleostearic, licanic, paranaric, tariric, gadoleic, arachidonic, cetoleic, etc. Particularly good results have been obtained with mixed unsaturated fatty acid esters, such as are obtained from animal fats and vegetable oils, such as tall oil, linseed oil, olive oil, castor oil, peanut oil, rape oil, fish oil, sperm oil, and so forth.

Exemplary fatty esters include lauryl tallate, methyl oleate, ethyl oleate, lauryl oleate, cetyl oleate, cetyl linoleate, lauryl ricinoleate, oleyl linoleate, oleyl stearate, and alkyl glycerides.

Cross-sulfurized ester olefins, such as a sulfurized mixture of $C_{10}$–$C_{25}$ olefins with fatty acid esters of $C_{10}$–$C_{25}$ fatty acids and $C_1$–$C_{25}$ alkyl or alkenyl alcohols, wherein the fatty acid and/or the alcohol is unsaturated may also be used.

Sulfurized olefins which may be used as an antioxidant in the practice of this invention are prepared by the reaction of the $C_3$–$C_6$ olefin or a low-molecular-weight polyolefin derived therefrom with a sulfur-containing compound such as sulfur, sulfur monochloride, and/or sulfur dichloride.

Another class or organic sulfur-containing compounds which may be used is sulfurized aliphatic esters of an olefinic mono- or dicarboxylic acid, for example aliphatic alcohols of 1–30 carbon atoms, used to esterify monocarboxylic acids such as acrylic acid, methacrylic acid, 2,4-pentadienoic acid and the like, or fumaric acid, maleic acid, muconic acid, and the like. Sulfurization is carried out by combining these esters with elemental sulfur, sulfur monochloride and/or sulfur dichloride.

The preferred antioxidants are the aromatic and alkyl sulfides, such as dibenzylsulfide, dixylyl sulfide, dicetyl sulfide, diparaffin wax sulfide and polysulfide, cracked wax-olefin sulfides and so forth. They can be prepared by treating the starting material, e.g., olefinically unsaturated compounds, with sulfur, sulfur monochloride, and sulfur dichloride, particularly preferred are the paraffin wax thiomers described in U.S. Pat. No. 2,346,156.

All of the sulfides and polysulfides included within the scope of this invention are sulfurized sulfides and polysulfides. That is, the sulfide or polysulfide has been reacted with additional sulfur, sulfur monochloride or sulfur dichloride after the initial formation of the sulfide. Residual chlorine that may be present in the antioxidant after sulfurization is not detrimental and may be beneficial.

The Quaternary Ammonium Halide

The second component of the additive composition for use in the lubricating oil is an oil-soluble quaternary ammonium halide. The quaternary ammonium halides will contain an oil-solubilizing hydrocarbon group and will generally contain at least 12 carbon atoms and may contain 50 or more carbon atoms. Preferably the quaternary ammonium halides have a boiling point in excess of 350° F. so that it does not vaporize out of the lubricant mixture at elevated temperatures.

One preferred class of quaternary ammonium halide may be represented by the formula:

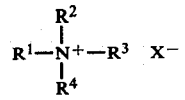

where $X^-$ is Cl, Br or I, and $R^1$, $R^2$, $R^3$ and $R^4$ are independently alkyl, alkaryl or aralkyl groups of 1 to 20 carbon atoms, provided that the quaternary ammonium halide has at least 12 carbon atoms. Preferably $X^-$ is Cl or Br.

Representative compounds include octyl trimethyl ammonium chloride, dodecyl trimethyl ammonium bromide, eicosyl trimethyl ammonium iodide, octyldecyl dimethyl ethyl ammonium chloride, nonadecyl diethyl methyl ammonium bromide, undecyl octyl ethyl methyl ammonium chloride, trioctyl methyl ammonium chloride, nonylphenyl trimethyl ammonium chloride, tetradecylphenyl trimethyl ammonium chloride, octylbenzyl trimethyl ammonium chloride, diisobutylphenyl trimethyl ammonium chloride, and 2-ethylhexyltriethyl ammonium bromide. Particularly preferred are cetyl dimethyl ethyl ammonium bromide, hexadecyl dimethyl ethyl ammonium chloride, and methyl tricapryl ammonium chloride.

Another class of quaternary ammonium halides includes the 5- or 6-member heterocyclic ring compounds, for example those represented by the formula:

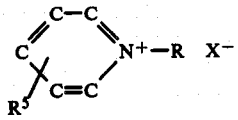

where $X^-$ is Cl, Br or I, and R is an alkyl group of 1 to 20 carbon atoms, $R^5$ is hydrogen or an alkyl group of 1 to 20 carbon atoms, provided that the total number of carbon atoms is at least 12. Representative compounds include eicosyl pyridinium bromide, heptadecyl pyridinium iodide, amyl pyridinium chloride, diisobutyl pyridinium chloride, nonyl pyridinium chloride, 2-ethylhexyl pyridinium chloride, methyl 4-dodecyl pyridinium chloride, ethyl 2-octadecyl pyridinium bromide, isopropyl 3-nonyl pyridinium bromide, and nonadecyl 4-methyl pyridinium chloride. Particularly preferred is lauryl pyridinium chloride.

The quaternary ammonium halides of the present invention and methods for their preparation are well known in the art. In general they are made by the reaction of a tertiary amine and an alkyl halide.

THE OIL-SOLUBLE ZINC SALT

The zinc salts which may be used in this invention are oil-soluble zinc salts. They are used in the lubricating oil to supply from 9 to 40 mmols of zinc per kilogram of oil.

The zinc salt is preferably a zinc dihydrocarbyldithiophosphate having from 4 to 20 carbon atoms in each hydrocarbyl group. The zinc dihydrocarbyldithiophosphate is formed by reacting the corresponding dihydrocarbyldithiophosphoric acid with a zinc base, such as zinc oxide, zinc hydroxide and zinc carbonate. The hydrocarbyl portions may be all aromatic, all aliphatic, or mixtures thereof.

Exemplary zinc dihydrocarbyldithiophosphates include:

zinc di(n-octyl)dithophosphate,
zinc butyl isooctyl dithiophosphate, zinc di(4-methyl-2-pentyl)dithiophosphate,
zinc di(tetrapropenylphenyl)dithiophosphate,
zinc di(2-ethyl-1-hexyl)dithiophosphate,
zinc di(isooctyl)dithiophosphate,
zinc di(hexyl)dithiophosphate,
zinc di(ethylphenyl)dithiophosphate,
zinc di(amyl)dithiophosphate,
zinc di(alkylphenyl)dithiophosphate,
zinc butylphenyldithiophosphate, and
zinc di(octadecyl)dithiophosphate.

Preferred compounds are those zinc dihydrocarbyldithiophosphates having from 4 to 18 carbon atoms in each hydrocarbon group. Especially preferred are the zinc dialkyldithiophosphates wherein each alkyl group typically contains from 4 to 8 carbon atoms and the zinc di(alkylaryl)-dithiophosphates wherein each alkylaryl group contains from 15 to 21 carbon atoms.

The lubricating oil composition is prepared by admixing, by conventional mixing techniques, the desired amount of antioxidant and quaternary ammonium halide in a suitable lubricating oil. The selection of the particular base oil and quaternary ammonium halide, as well as the amounts and ratios of each, depends upon the contemplated application of the lubricant and the presence of other additives. Generally, however, the amount of oil-soluble antioxidant employed in the lubricating oil will vary from 0.25 to 10, and usually from 0.25 to 2, weight percent. The quaternary ammonium halide will range from 0.01 to 2, and usually from 0.01 to 0.3, preferably from 0.05 to 0.3, weight percent based on the weight of the final composition. The weight ratio of organic oil-soluble antioxidant to quaternary ammonium halide will generally vary from 5–20 to 1, and usually from 10–20 to 1.

Concentrates of the new additive composition of this invention can be prepared for easier handling and storage of the additive. Usually the concentrate will be 10 to 90% by weight additive composition and from 10 to 90% by weight lubricating oil diluent. Preferably the additive composition comprises 20 to 80% by weight of the lubricating oil additive concentrate. This concentrate is diluted with additional oil before use.

The lubricating oil which may be used includes a wide variety of hydrocarbon oils such as naphthenic base, paraffin base, and mixed base oils. Other oils include lubricating oils derived from coal products and synthetic oils, e.g., alkylene polymers (such as propylene, butylene, and so forth, and mixtures thereof), alkylene oxide-type polymers (e.g. alkylene oxide polymers prepared by polymerizing alkylene oxides, such as ethylene oxide, propylene oxide, etc. in the presence of water or alcohol, e.g., ethyl alcohol), carboxylic acid esters (e.g., those which are prepared by esterifying carboxylic acids, such as adipic acid, azelaic acid, suberic acid, sebacic acid, alkenyl-succinic acid, fumaric acid, maleic acid and so forth, with an alcohol such as butyl alcohol, hexyl alcohol, 2-ethylhexyl alcohol, pentaerythritol and so forth, liquid esters of phosphorus-containing acids such as trialkyl phosphate, tricresyl phosphate, etc., alkylbenzenes, polyphenyls (e.g., biphenyls and terphenyls), alkylbiphenyl ethers, esters and polymers of silicon, e.g., tetraethylsilicate, tetraisopropylsilicate, hexyl(4-methyl-2-pentoxy)disilicate, poly(methyl)siloxane, and poly(methylphenylsiloxane) and so forth. The lubricating oils may be used individually or in combinations whenever miscible, or whenever made so by use of mutual solvents. The lubricating oils generally have a viscosity which ranges from 50 to 5000 SUS (Saybolt Universal Seconds), and usually from 100 to 1500 SUS at 100° F.

In addition to the antioxidant, the quaternary ammonium halide and the oil-soluble zinc salt, other additives may be used in the lubricating composition without affecting its high stability and performance over a wide temperature scale. One type of additive which may be used is a rust inhibitor. The rust inhibitor is used in many types of lubricants to suppress the formation of rust on the surface of metallic parts. Typical rust inhibitors include sodium nitrite, alkenylsuccinic acid and derivatives thereof, alkylthioacetic acid and derivatives thereof, polyglycols and derivatives thereof, and alkoxylated amines and derivatives thereof. Other types of lubricating additives which may be used are metallic or ashless dispersants and detergents. Typical of these are the conventional succinimides, succinates, hydrocarbylalkylene polyamines, alkaline earth metal salts of alkylaryl sulfonates, phenates and the like.

Other types of lubricating oil additives which may be used include antifoam agents (e.g., silicones, organic copolymers), stabilizers and antistain agents, tackiness agents, antichatter agents, dropping point improvers and antisquawk agents, lubricant color correctors, extreme-pressure agents, odor control agents, detergents, antiwear agents, thickeners, and so forth.

LUBRICANT PERFORMANCE

The presence of the quaternary ammonium halide in the lubricant composition increases the antioxidation properties of the oil-soluble, sulfur-containing antioxidant. With this combination, less of the antioxidant is necessary in the lubricant to achieve the desired antioxidation properties. If the antioxidant is used at conventional levels, increased oxidation protection is obtained.

The following examples are presented to illustrate the practice of specific embodiments of this invention and should not be interpreted as limitations on the scope of this invention.

EXAMPLE 1

The combination of various quaternary ammonium halides with the antioxidant in improving the antioxidation properties of a lubricating oil over the use of either of the components individually is illustrated by the following test. The oxidation test uses the resistance of the test sample to oxidation using pure oxygen with a Dornte-type oxygen absorption apparatus (R.W. Dornte, "Oxidation of White Oils," Industrial and Engineering Chemistry, Vol. 28, page 26, 1936). The conditions are an atmosphere of pure oxygen exposed to the test oil maintained at a temperature of 340° F. The time required for 100 g of test sample to adsorb 1000 ml of oxygen is observed and reported in the following Table I. The test oil contains 6% of a conventional succinimide dispersant, 0.05% of terephthalic acid, 0.4% of a conventional rust inhibitor and 9 mmols/kg of a zinc dithiophosphate in Cit-Con 30.

TABLE I

| Test No. | Antioxidant,% | Quaternary Halide | Oxidation Life Hours |
|---|---|---|---|
| 1 | — | — | 5.2 |
| 2 | 1% diparaffin polysulfide | — | 6.5 |
| 3 | " | 0.1%(1) | 16.3 |
| 4 | " | 0.05%(1) | 9.6 |
| 5 | " | 0.10(2) | 13.7 |
| 6 | " | 0.1%(3) | 16.0 |
| 7 | " | 0.12%(4) | 10.6 |

TABLE I-continued

| Test No. | Antioxidant,% | Quaternary Halide | Oxidation Life Hours |
|---|---|---|---|
| 8 | " | 0.2%(4) | 16.0 |

(1)Lauryl pyridinium chloride.
(2)Methyl tricapryl ammonium chloride.
(3)Cetyl dimethyl ethyl ammonium bromide.
(4)Hexadecyl dimethyl ethyl ammonium bromide.

EXAMPLE 2

The test procedure described in Example I was repeated and in addition to the time to absorb 1 liter of oxygen, total oxygen uptake after 10 hours, and percent viscosity increase after 10 hours (100° F.) were obtained. Base oil A consisted of 6% of a conventional succinimide dispersant, 50 mmols/kg of a magnesium sulfonate (alkalinity value of 400) and 18 mmols/kg of a zinc dithiophosphate in Cit-Con 30. Base oil B consisted of 6% of a conventional succinimide dispersant, 30 mmols/kg of a magnesium sulfonate (alkalinit value of 400), 20 mmols/kg of a carbonated, sulfurized, calcium polyalkylphenate, 18 mmols of a zinc dithiophosphate in Cit-Con 30. The results appear in Table II.

TABLE II

| Test No. | Base Oil | Anti-oxidant, % | Quaternary Ammonium Halide, % | Hrs. to 1 Liter $O_2$ | Liters $O_2$ 10 Hrs. | % Viscosity Change 10 Hrs. |
|---|---|---|---|---|---|---|
| 1 | A | — | — | 4.2 | 9.2 | 160 |
| 2 | A | 1%(1) | — | 4.5 | 8.2 | 140 |
| 3 | A | 1%(1) | 0.1%(2) | 6.3 | 5.5 | 141 |
| 4 | A | 1%(3) | — | 4.2 | 7.8 | 114 |
| 5 | A | 1%(3) | 0.1%(2) | 6.7 | 7.0 | 57 |
| 6 | A | 1%(4) | — | 3.8 | 8.8 | 134 |
| 7 | A | 1%(4) | 0.1%(2) | 4.3 | 10.3 | 140 |
| 8 | B | — | — | 5.9 | 6.1 | 71 |
| 9 | B | 1%(1) | — | 6.5 | 6.1 | 47 |
| 10 | B | 1%(1) | 0.1%(2) | 8.3 | 1.3 | 1 |
| 11 | B | 1%(3) | — | 6.2 | 7.3 | 54 |
| 12 | B | 1%(3) | 0.1%(2) | 8.8 | 4.2 | 27 |
| 13 | B | 1%(4) | — | 6.0 | 7.8 | 89 |
| 14 | B | 1%(4) | 0.1%(2) | 6.9 | 8.3 | 61 |

(1)Diparaffin polysulfide.
(2)Ethylhexyldimethylammonium bromide.
(3)Tallate cracked wax olefin (10.2% sulfur).
(4)Sulfurized 2-ethylhexyl acrylate (16% sulfur).

What is claimed is:

1. An additive composition for use in crankcase lubricating oils comprising:
   (1) an oil-soluble antioxidant selected from aromatic or alkyl sulfides and polysulfides, sulfurized olefins, sulfurized carboxylic acid esters, and sulfurized ester-olefins, and
   (2) an oil-soluble quaternary ammonium halide wherein the weight ratio of antioxidant to quaternary ammonium halide is in the range of from 1 to 0.001–21.

2. The composition of claim 1 comprising an oil of lubricating viscosity, from 0.25 to 10% weight of said antioxidant and from 0.001 to 5% weight of said quaternary ammonium halide.

3. The composition of claim 1 wherein said quaternary ammonium halide is represented by the formula:

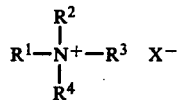

wherein $X^{31}$ is Cl, Br or I, and $R^1$, $R^2$, $R^3$ and $R^4$ are independently alkyl, alkaryl or aralkyl groups of 1 to 20 carbon atoms, provided that the quaternary ammonium halide has at least 12 carbon atoms.

4. The composition of claim 3 wherein $X^-$ is Cl or Br.

5. The composition of claim 3 wherein said quaternary ammonium halide is ethylhexyldimethylammonium bromide.

6. The composition of claim 3 wherein said quaternary ammonium halide is hexadecyldimethylethylammonium bromide.

7. The composition of claim 3 wherein said quaternary ammonium halide is methyl tricapryl ammonium chloride.

8. The composition of claim 1 wherein said quaternary ammonium halide is represented by the formula:

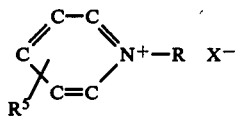

where $X^-$ is Cl, Br or I, and R is an alkyl group of 1 to 20 carbon atoms, and $R^5$ is hydrogen or an alkyl group of 1 to 20 carbon atoms, provided that the total number of carbon atoms is at least 12.

9. The composition of claim 8 wherein said quaternary ammonium halide is lauryl pyridinium chloride.

10. A lubricating oil concentrate comprising from 90–10% by weight of an oil of lubricating viscosity and from 10–90% by weight of the composition of claim 1.

11. A lubricating oil composition comprising an oil of lubricating viscosity and an anitoxidant amount of the composition of claim 1.

12. The composition of claim 11 wherein the antioxidant is a wax sulfide or polysulfide.

13. The composition of claim 11 which also contains an antioxidant-antiwear amount of an oil-soluble zinc salt.

14. The composition of claim 13 wherein the zinc salt is a zinc dihydrocarbyldithiophosphate.

* * * * *